US005472003A

United States Patent [19]

Frame et al.

[11] Patent Number: 5,472,003

[45] Date of Patent: Dec. 5, 1995

[54] HAIR ACCESSORY FOR PONYTAIL

[76] Inventors: Chad R. Frame; Bridget R. Frame, 1920 Parkview Ave., both of Rock Springs, Wyo. 82901

[21] Appl. No.: 181,996

[22] Filed: Jan. 14, 1994

[51] Int. Cl.[6] ..... A45D 8/12

[52] U.S. Cl. ..... 132/275; 132/273; D. 28/41

[58] Field of Search ..... 132/273, 274, 132/275; 54/78; D 28/41, 39; 119/850, 809

[56] References Cited

U.S. PATENT DOCUMENTS

| | | | |
|---|---|---|---|
| 127,918 | 6/1872 | Parson . | |
| 149,784 | 4/1874 | Oliphant | 2/170 |
| D 205,829 | 9/1966 | Gettinger | D3/13 |
| 292,030 | 9/1887 | Revson | D28/41 |
| 313,485 | 1/1891 | Malouf | D28/41 |
| 315,036 | 2/1891 | Leopold | D28/41 |
| 315,226 | 3/1891 | Revson | D28/41 |
| 336,544 | 7/1893 | Maturaporn | D28/41 |
| 348,331 | 6/1894 | Marrese | D28/41 |
| D 353,226 | 12/1994 | Nahoum | D28/41 |
| 1,883,062 | 10/1932 | Steinberger | 2/159 |
| 2,211,184 | 8/1940 | Varell | D28/41 X |
| 2,249,550 | 7/1994 | Williams | 2/170 |
| 2,522,842 | 9/1947 | Scholl | 602/63 X |
| 2,579,089 | 12/1951 | Price | 132/274 |
| 2,604,629 | 7/1952 | Kennedy | 2/170 |
| 2,864,383 | 12/1957 | Jacks et al. | 2/171 X |
| 3,648,291 | 3/1972 | Pankers | 2/16 |
| 3,968,792 | 7/1976 | Small | 128/132 D |
| 4,378,667 | 4/1983 | Velarde, Jr. | 119/850 |
| 4,706,304 | 11/1987 | Jones | 2/91 |
| 5,044,385 | 9/1991 | Rhodes et al. | 132/273 |
| 5,156,171 | 10/1992 | Goodman | 132/200 |

FOREIGN PATENT DOCUMENTS

| | | | |
|---|---|---|---|
| 2595927 | 9/1987 | France | 132/212 |
| 26670 | 10/1904 | United Kingdom | 132/274 |

*Primary Examiner*—John G. Weiss
*Attorney, Agent, or Firm*—Berne S. Broadbent; A. John Pate

[57] ABSTRACT

A hair retainer 10 holds a ponytail of a user while selectively covering any desired portion of the ponytail. The preferred embodiment is a sleeve 12 having a top loop 14, which may include a tie 100, proximate one end near the head of a user to gather the hair and secure the ponytail. A bottom loop 16, secured to gather the opposite end of the sleeve, restrains the hair of the ponytail. The bottom loop 16 also grips the hair to position the bottom loop 16 and set the effective length 28 of the sleeve 12 relative to the ponytail. The tie 100 may comprise an elastic material. A plurality of gathers 18, 20, 34 may be distributed along the sleeve 12 around the circumference of the sleeve 12, positioning and blousing the sleeve 12 between gathers 18, 20, 34, and between the top and bottom loops 14, 16. The sleeve may assist in isolating the hair from contamination and damage in medical and industrial environments, and from interference with work by hair falling into a user's face. The sleeve 12 may also assist in reducing contamination of controlled environments such as hospitals, precision mechanical and electronic manufacturing rooms, clean-rooms, and food preparation sites by hair and dust and from electrostatic discharge.

26 Claims, 9 Drawing Sheets

HAIR ACCESSORY FOR PONYTAIL

BACKGROUND OF THE INVENTION

1. Field of the Invention

The device of the invention relates generally to hair accessories and more particularly to retainers for long hair when formed into a "ponytail."

2. State of the Art

Long hair has been the subject of numerous utilitarian and fashion accessories since the dawn of recorded history. For reasons of aesthetics, convenience, safety and health, hair worn long must often be retained by some means. A balance between aesthetic decorative treatments and utilitarian restraint has resulted in a host of available products to meet health, sanitation, or safety needs, particularly if a ponytail is worn.

Control of the hair, mobility of the head, aesthetics and containment are all desirable and not available from many of the available hair retention means. Thus, a necessary article is a retainer for long hair. Preferably, the retainer should be functional in controlling hair, keeping it away from the face in the workplace. Ideally, the retainer should lend itself to fashionable treatments for various aesthetic tastes.

SUMMARY

The invention is an accessory for hair worn in a ponytail, the accessory comprising a sleeve extending along and surrounding the hair of a user.

A first loop is associated with the sleeve proximate a first end thereof for securing the hair of a user in a ponytail, and a second loop is associated with the sleeve proximate a second end thereof for positioning the sleeve with respect to the length of the hair of a user.

The first loop may be comprised of a ribbon, cord, or inelastic band having two ends for tying to itself. In another embodiment, the first loop is comprised of an elastic material for stretching by a user to a first circumference and for contraction under elastic forces to a second circumference for holding the hair. In the preferred configuration, the first circumference may be greater than 5 inches and the second circumference may be less than 5 inches.

In one embodiment of the retainer, the second loop is spaceable apart from the first loop. The sleeve extends between the first loop and the second loop. Likewise, a third loop or gather similar to the second loop may be provided or a gathering material may be attached to the sleeve intermediate the first and second loops for gathering the circumference of the sleeve. The intermediate third loop or gather may be sized for aesthetic purposes or for added stability and retention as well as for sizing and placement of the retainer along the length of the ponytail.

In an alternate embodiment, a plurality of gathers may be distributed along the length of the sleeve. Each gather of the plurality of gathers may be positionable with respect to the first loop by a user.

In one embodiment, the retainer may be constructed with the second loop configured to selectively close one end of the sleeve for completely containing the hair of a user in the sleeve. In this configuration, the hair can selectively extend outside the sleeve beyond the open second loop.

In one embodiment of the retainer, the sleeve may be comprised of a synthetic polymer. The sleeve may alternatively be comprised of a non-woven paper fabric, a chemical-resistant material, a heat-resistant material, an electrically conductive material, a conventional textile fabric, a moisture absorbent material, a moisture resistant material, a dielectric material, a material engineered for collecting airborne particulates, a perforated material, or a metallic material.

A sleeve is a substantially tubular member having open ends, but completely surrounding the hair in a continuous tube of material. The tubular member may be adjusted to appear long or short, extended or bunched, and is gathered near each end. The sleeve may be configured like a sleeve in a garment, similarly having no closed end. In an alternative embodiment, one end of the sleeve may be selectively closed. Another alternative embodiment includes an extension of fabric creating a ruffle at one end of the sleeve to extend away from the hair.

Fabric is a material which can be formed to extend over a surface and may be any material which can be wrapped to enclose an object. Fabric may include conventional textiles such as cotton, sill, linen, wool, and synthetic fibers form the fabrics, whether knit, woven or bonded. Metals, elastomers, commonly used plastics and other polymers in woven and non-woven configurations are also contemplated. For example, NOMEX™, which is chemical and heat resistant, and polyethylene, which is chemical resistant, may have applications where their unique properties increase the utility of the invention. Likewise, metal conductors discharge static buildup, a property of great significance for persons working near electronic components or chips. Moreover, metals can be formed into woven fabric, threads in conventional fabric, coils, links or mail, all of which are here included in the meaning of "fabric."

Surrounding the hair may include placing a string, tie, band or object in a position to encircle the hair near the back of the head as the hair is formed into a bundle distinctive of a ponytail. The hair is drawn back on the head and gathered into a bundle, typically near the base of the skull although a ponytail may be formed to one side or near the top of the head. The classical ponytail is formed by so restraining the hair only near the head, allowing the hair to flow more-or-less freely therebeyond, like the tail of an actual pony. Capturing the bundled hair near the head and restraining it principally there is the essential element of forming a ponytail.

In one embodiment, the fabric is a chemical resistant material. Chemical-resistant material is any one of a class of materials which is not subject to chemical attack. That is, it is not reactive with corrosives up to strong acids and bases, nor soluble by solvents. The expression "chemical- resistant" necessarily includes any material which has individually selected characteristics for a special task at hand. Thus a material is chemical-resistant if it is selected to resist attack by a specific chemical agent in use or up to a specific strength of chemical. Thus, a single material need not be resistant to numerous chemicals nor maximum strengths of an individual chemical to be considered chemically resistant. Rather, if a material is used for the purpose of its chemical resistance to an agent, then it is chemically resistant in that application.

In another embodiment, the fabric may be a non-woven fabric. Non-woven fabrics include paper and non-paper materials which are comprised of bonded synthetic and natural fibers. Some examples are disposable clothing, towels, and diaper liner materials, "Nomex™" synthetic bonded fabrics, Tyvek™ and felt of natural cotton or wool. Non-woven paper fabric includes a broad range of flexible paper materials. For example, paper fabrics are used in disposable clothing, diapers, towels and the like. The principal characteristics of the non-woven paper fabrics are conformability to various shapes, flexibility, structural integrity under crushing and stressing, and the soft texture. The texture allows paper fabrics to be worn comfortably without chafing against the skin.

The circumference of the sleeve is adjustable. If provided with an elastic loop, the sleeve can be opened to place the hair through the sleeve. The circumference then may adjust to the hair. If any loop, such as the one closest to the head of a user, is a tying loop, then the loop is comprised of a lace, cord, string, ribbon or the like that can be tied in a bow, like a shoe lace, after being drawn tight. The loop is drawn through a tube-like passage hemmed in the circumference of the sleeve. In an alternate embodiment the loop may be formed by a lace threaded in and out through perforations about the circumference of the sleeve.

The circumference of the sleeve is not necessarily circular. However, by circumference is meant the distance around a closed path at an axial position of the sleeve or a loop.

A passage is an enclosed way formed by fabric folded over and sealed, typically by hemming, to capture a lace, cord, string, ribbon or other narrow object at the axial position of the way along the sleeve, restricting such lace, cord, string, ribbon or object to motion in the direction of the way.

A loop in its usual sense is an elongated, thin member such as a ribbon or string completely closed on itself. A ribbon wrapped around an object and tied to itself is an example, as is a circular band of elastic. A loop may also include such a "loop" as defined above and the associated way in the sleeve capturing the "loop" to become a "top loop" or "bottom loop."

A flexible loop must necessarily take on the shape of the object it circumscribes. For example, an elastic loop held open by the fingers of a hand of a user will necessarily extend between the fingers as an irregular polygon, not as a circle. Nevertheless, it is proper to discuss a distance around such a polygon as a circumference of a loop.

Discussing a diameter of a loop is less useful. However, diameter is any of several paths traversing between opposing sides of a loop. An irregular polygon of the example necessarily has several diameters depending upon the location of such a measurement. As a single comparative number, an effective diameter may be useful as a definition of the diameter of an irregular object. Effective diameter is four (4) times the enclosed area, divided by the total perimeter (circumference).

A lace is a cord or other elongated member having two ends for tying, typically in a bow or other easily releasable knot. Laces in shoes are tied in a bow, as are hair ribbons, fabric bands and cords of gmat variety. All such tying materials are within contemplation as a lace or tie or loop. In the invention, such a lace may be threaded through a hemmed passage proximate the circumference of the sleeve.

A hemmed passage or way may extend along an entire circumference in a closed path open only at one location on the circumference to allow the two ends of the lace to extend for tying. Alternately, a lace may simply be threaded through short enclosed segments of a path, alternatingly exiting and entering the short segments. The effect is that the lace is visible periodically about the circumference. A lace may be simply threaded in and out through holes like buttonholes formed through the sleeve around a circumference. In each of these embodiments, the lace may be drawn tight, gathering the sleeve, or released, freeing the sleeve to open to a larger circumference.

Several loops and gathers may be elastically compliant whether tied or not. An elastically compliant material deflects, is stretchable, returning to its original shape more-or-less elastically. Conventional synthetic and natural rubber bands operate in this manner as does conventional shock cord. Not elastically compliant are materials having little deflection compared to an elastomeric material. Cotton string, textile ribbon, metal wire, woven, non-elastomeric textile fabric and conventional cord are not elastically compliant within this definition.

DETAILED DESCRIPTION OF THE PREFERRED EMBODIMENTS

Figure 3:
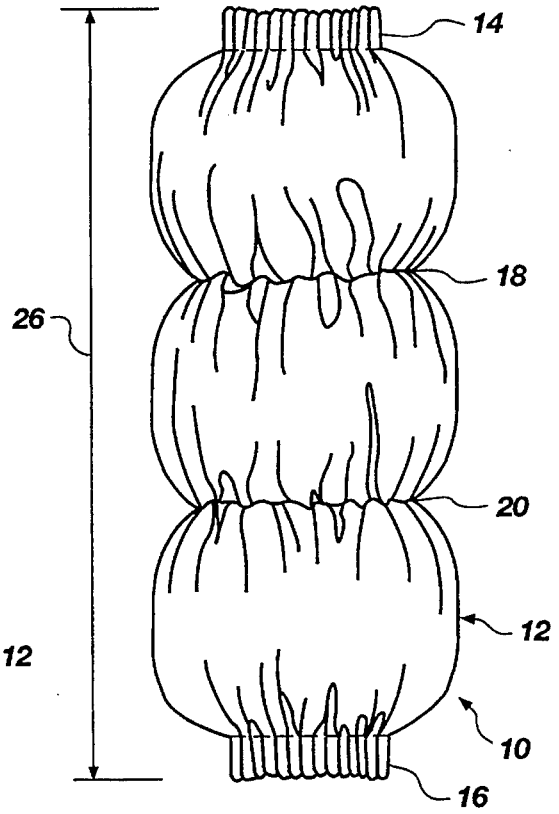
FIG. 3 is a rear elevation view of the accessory of FIG. 1.
Figure 4:
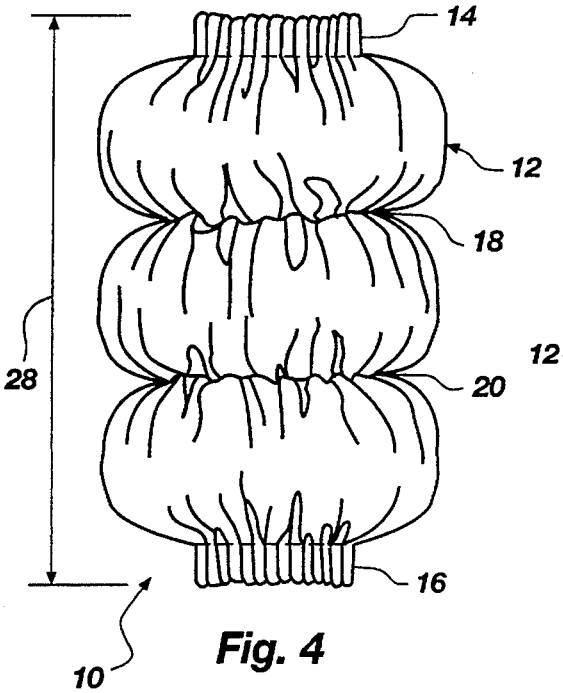
FIG. 4 is a rear elevation view of the accessory of FIG. 1 partially compressed axially.
Figure 5:
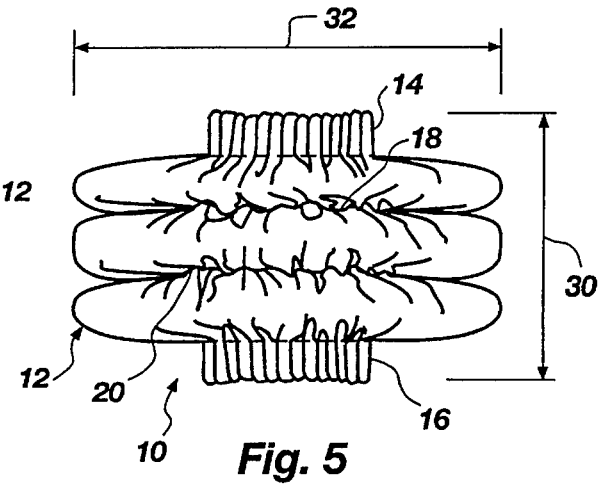
FIG. 5 is a rear elevation view of the accessory of FIG. 1 in a highly-compressed configuration.

The invention is best understood by reference to FIGS. 1–5 illustrating the retainer 10, alternately referred to as the hair accessory 10 of the invention. The retainer 10 is comprised of a sleeve 12 having a top loop 14 and a bottom loop 16. Intermediate the top loop 14 and bottom loop 16 are positioned a first gather 18 and, in the embodiment shown, a second gather 20. An aperture 21 is formed by the surrounding sleeve 12 to have an inside diameter 22 defined by the top loop 14 and bottom loop 16. The outside diameter 24 is defined by the fabric which forms the sleeve 12. The length 26 of the sleeve 12 may be varied between an intermediate length 28 (FIG. 4), a minimum length 30 (FIG. 5), or may be fully extended as illustrated in FIG. 3.

Figure 6:
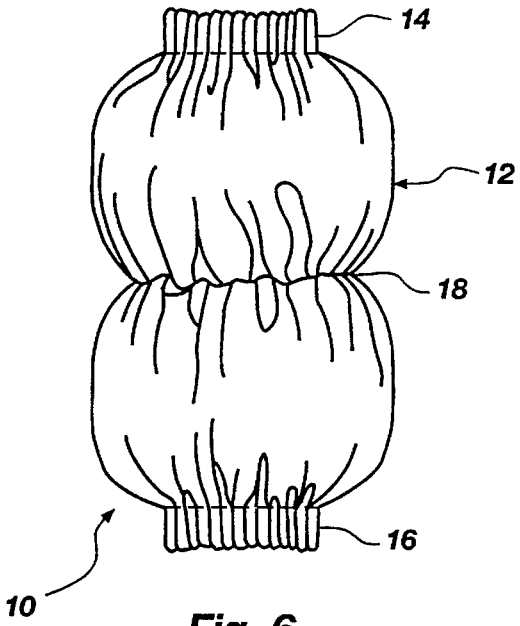
FIG. 6 is a rear elevation view of an alternate embodiment of the accessory of FIG. 1 having a single gather intermediate the end loops.
Figure 7:
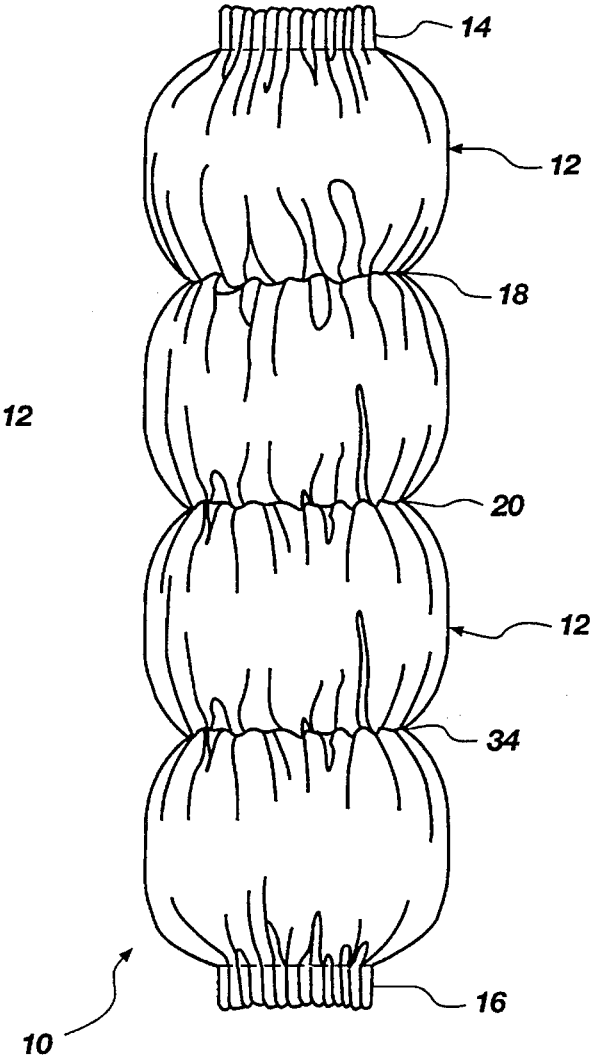
FIG. 7 is a rear elevation view of an alternate embodiment of the accessory of FIG. 1 having three intermediate gathers between the end loops.

In alternate embodiments, the sleeve 12 may have a single first gather 18, as illustrated in FIG. 6, or an additional third gather 34, as illustrated in FIG. 7. In any event, the top loop 14 secures the sleeve 12 to the hair. The top loop 14 also may serve the function of gathering the hair of a user. The top loop 14 may be provided with an elastic extending therethrough, the top loop 14 being subject to several means of gathering as described hereinafter.

Figure 8:
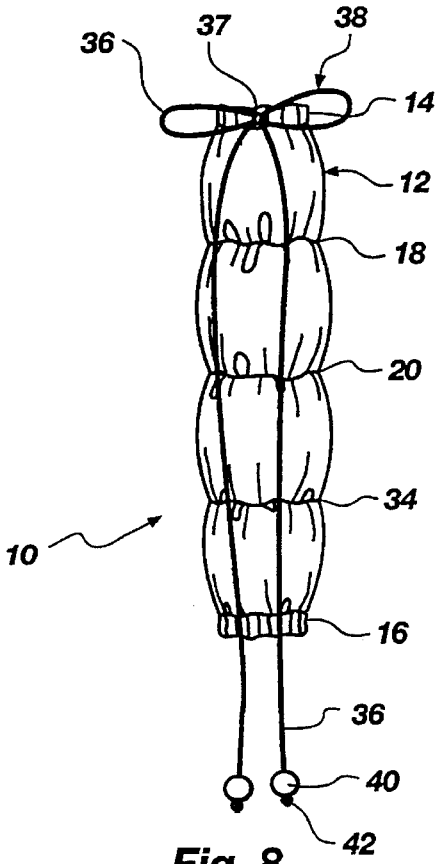
FIG. 8 is a rear elevation view of an alternate embodiment of an accessory of the invention having a cord as a tie rather than elastic in the top loop.

Alternate embodiments of the invention are best understood by reference to FIGS. 8–15. In FIG. 8, a cord 36 is threaded into the top loop 14 by way of an aperture 37, the cord 36 completely encircling the hair of a user thereby and being tightened and tied in a bow. The cord 36 is terminated by a knot 42 at each end thereof. The knots 42 securing beads 40 thereto. The beads 40 tend to hold the cord 36 in a downwardly-extending orientation.

Figure 9:
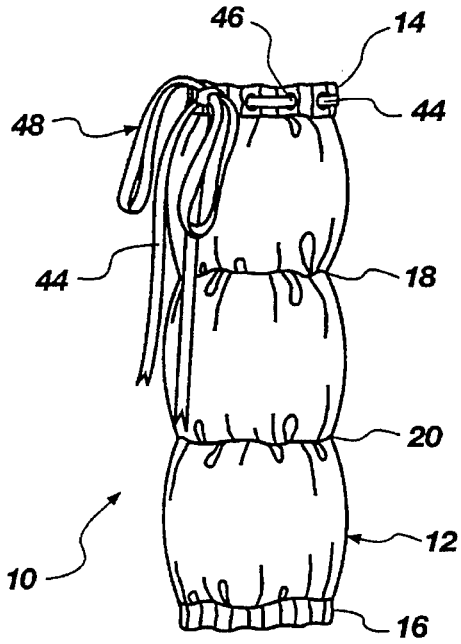
FIG. 9 is a rear elevation view of an alternate embodiment of the invention having a ribbon laced through the top of the sleeve to form and tighten the top loop around the hair of a user.

As seen in FIG. 9, a ribbon 44 may be laced into the top loop 14 through apertures 46 for tightening the top loop 14, the ribbon 44 being tied in a bow 48 for securement. In some embodiments (see FIGS. 10–11), the top loop 14 is best expanded to receive the hair of a user and afterward tightened by the use of an elongated band 50 internally elasticized to be stretchable. The band 50 is threaded through the apertures 46 formed in the top loop 14.

Figure 11:
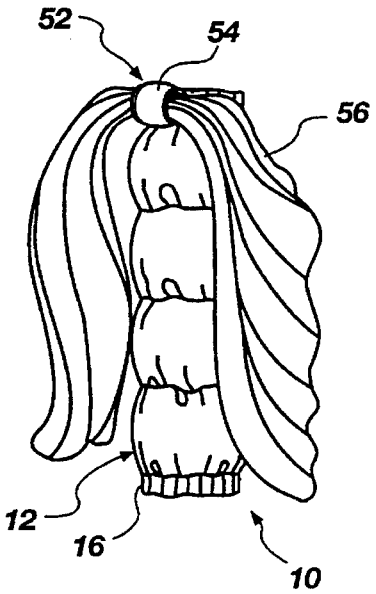
FIG. 11 is a rear elevation view of the accessory of FIG. 10.
Figure 10:
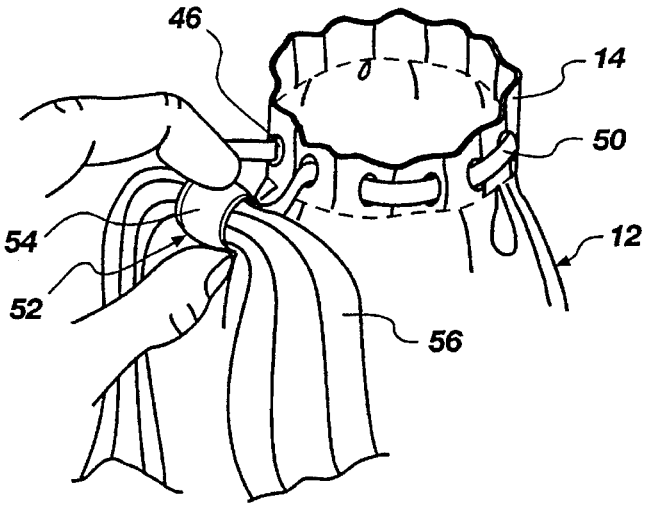
FIG. 10 is an isometric view of a portion of an alternate embodiment of the invention having a ring pull attached to the elastic in the top loop of the sleeve with a scarf placed through the ring.

The band 50 is completely closed on itself. For ease of grasping the band 50, a pull 52 is attached thereto. One suitable pull 52 is a ring 54 captured by the band 50 passing therethrough. A scarf 56 is held by the ting 54 to form a pull 52, which gives easy access to the band 50 for tightening. The band 50 may be drawn from the apertures 46 and wrapped around the top loop 14. The band 50 is preferably wrapped around the top loop 14 twice, placing the pull 52 at its original location as shown in FIG. 11.

Figure 12:
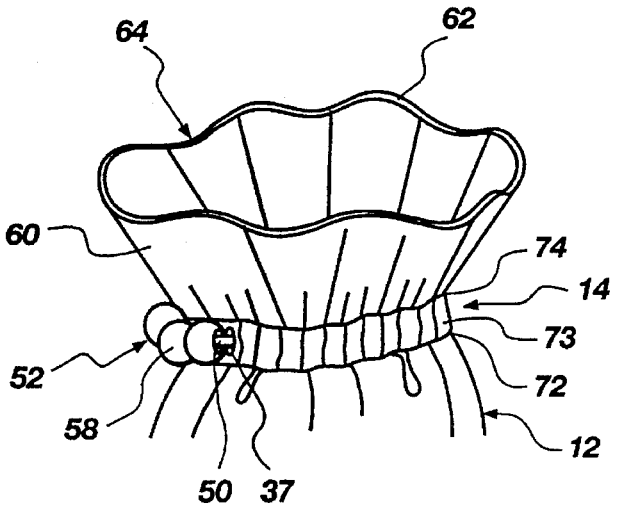
FIG. 12 is an isometric view of a portion of an alternate embodiment having a flared French ribbon effect above the top loop and a series of beads acting as a pull on the elastic in the top loop.

As an alternative to the ring 54, the beads 58 of FIG. 12 hold the band 50 clear of the aperture 37 for ease of access by a user. As also illustrated in FIG. 12, a flare 60 extends above the top loop 14 terminating with or without a stiffener 62 forming scallops along the edge thereof.

Figure 13:
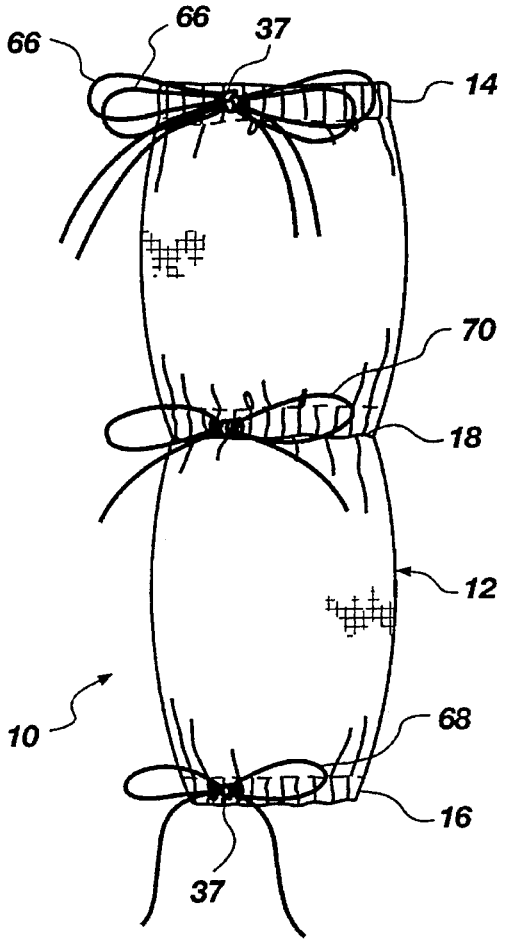
FIG. 13 is a rear elevation view of an alternate embodiment of the invention employing thin ribbons to close the top loop and bottom loop and to form the gather intermediate thereto.

In the alternative, the top loop 14 may be secured with the top ribbons 66 as illustrated in FIG. 13. Multiple top ribbons 66 are threaded through the top loop 14 as bottom ribbons 68 are threaded through the bottom loop 16. In addition, a gather ribbon 70 is threaded about the first gather 18.

As best seen in FIG. 12, the hem 72 and the hem 74 form a channel 73, which may be regarded as a tube 73 or way 73 for receiving the band 50 or the ribbons 66, 68, 70. A similar hem, shown in FIG. 14, forms the channel 73 for receiving the lace 76.

Figure 14:
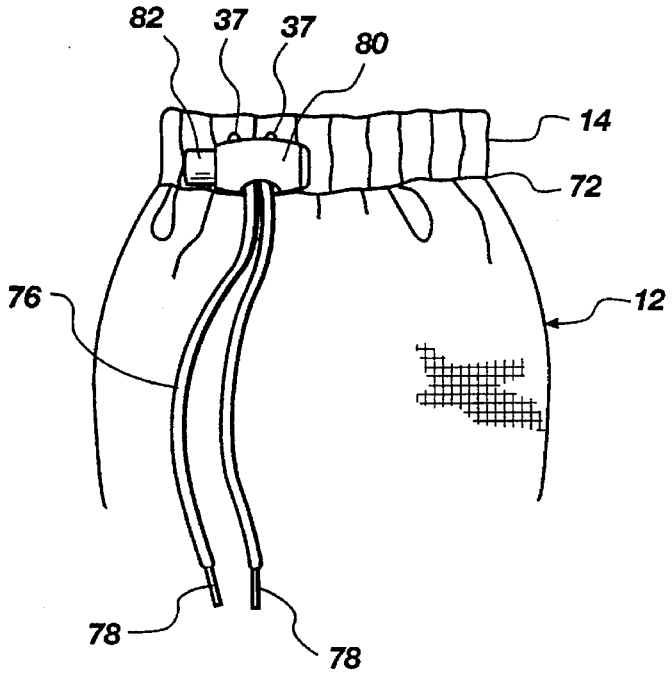
FIG. 14 is a rear elevation view of an alternate embodiment of the invention using a cord threaded through the top loop and secured by a cord lock.

In the illustration of FIG. 14, the lace 76 is a cord-like, round shoelace terminated by a wrap 78 at each end and secured to be tightenable by a cord lock 80. The cord lock 80 is released by the button 82, compression of which releases the lace 76, allowing it to be pulled back through the apertures 37, thereby permitting the top loop 14 to expand to release or receive the hair of a user.

Figure 15:
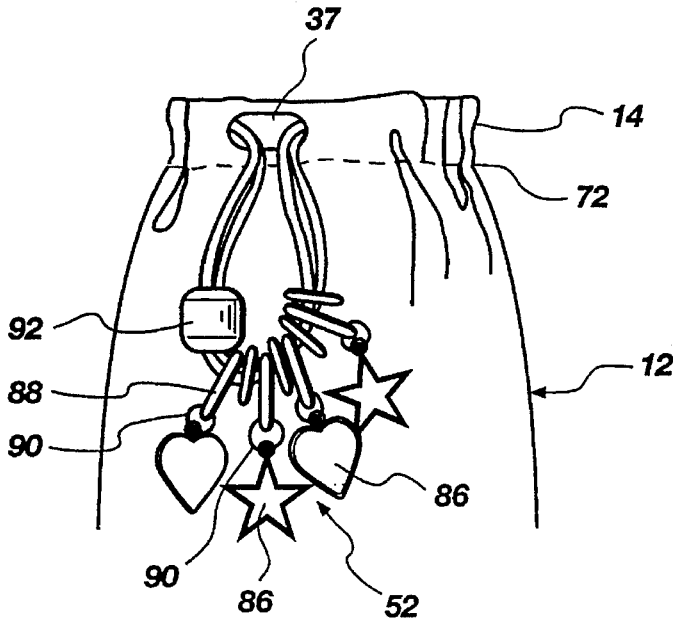
FIG. 15 is a rear elevation view of an alternate embodiment of the invention having baubles attached to the elastics threaded through the top loop, the baubles acting as a cord pull to tighten the elastic.

FIG. 15 illustrates the sleeve 12 of the invention gathered at the top loop 14 by shock cords 84 entering and exiting the top loop 14 through the aperture 37. The bangles 86 are connected by rings 88 to the shock cords 84 to form a pull 52. The tings 90 connect the bangles 86 to the rings 88. Also, a bead 92 is added with the bangles 86, being captured in a similar manner by the shock cords 84 passing therethrough. The entire assembly of bangles 86, tings 88 and the bead 92 form a pull 52 to prevent the shock cords 84 from retreating inside the aperture 37. That is, a user can easily access the shock cords 84, which perform the elastic function of tightening the top loop 14 around the hair of a user.

Figure 16:
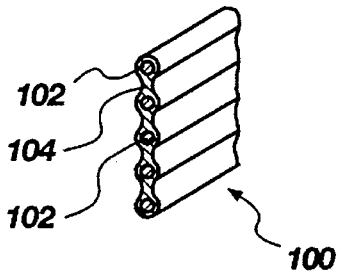
FIG. 16 is a sectioned isometric view of elastic strap suitable for use in the top and bottom loop of the invention or in a way of a gather.

FIGS. 16–20 illustrate various materials which can be threaded through the channel 73 in a top loop 14 or elsewhere along the sleeve 12 to gather the sleeve 12. FIG. 16 illustrates the cross-sectional view of the tie 100 or tether 100 threaded through the top loop 14 of the invention. In the tie 100, of FIG. 16, the elastic filaments 102 are captured within a fabric matrix 104 that is expandable. Thus, when the tie 100 is stretched, the elastic filaments 102 elongate, while the fabric matrix 104 follows.

Figure 17:
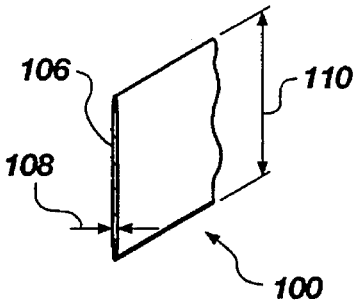
FIG. 17 is a sectioned isometric view of a segment of ribbon suitable for use in the top and bottom loops of the invention.
Figure 18:
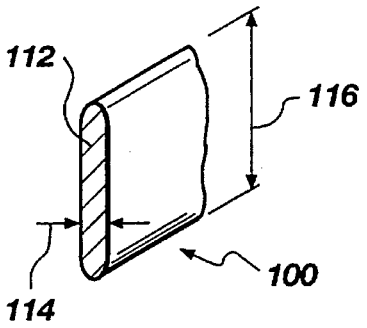
FIG. 18 is a sectioned isometric view of a lace, similar to a shoelace, for use in tightening and tying the top and bottom loops, and possibly the gathers in the invention.

The tie 100 of FIG. 17 is a ribbon 106, typically woven and having a thickness 108 substantially less than the width 110. The tie 100 of FIG. 18, by contrast, is lacing 112, typically formed of a fabric material and having a thickness 114 substantially larger with respect to the width 116 than the thickness 108 compared to the width 110 of FIG. 17.

Figure 19:
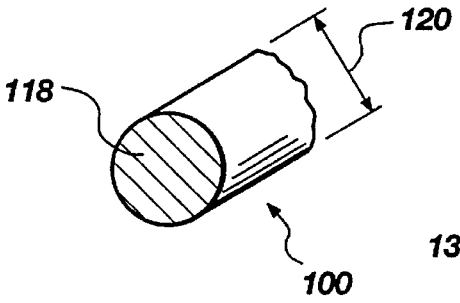
FIG. 19 is a sectioned isometric view of a segment of cord as used in the top and bottom loops and possibly in the gathers of the accessory of the invention.

The tie 100 of FIG. 19 is a cord 118, which may be a monofilament type, but is more likely woven or even woven and wrapped. The diameter 120 of the cord 118 is preferably of a dimension to fit through the aperture 37 of the top loop 14 of the sleeve 12 as do the ribbon 106 and lace 112 of FIGS. 17 and 18, respectively.

Figure 20:
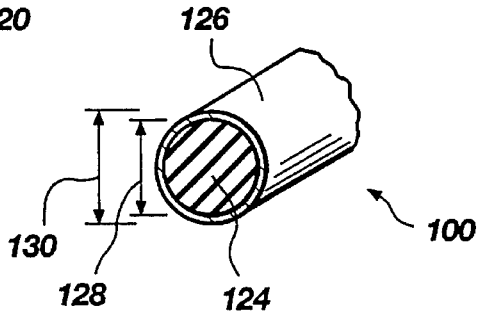
FIG. 20 is a sectioned isometric view of elasticized cord for use in the top and bottom loops and in the gathers of the accessory of the invention.

The tie 100 of FIG. 20 has elastic 124, which may be comprised of a number of filaments or a single filament, contained within a sheath 126. The sheath 126 is expandable, and typically manufactured of some type of durable fabric. The diameter 128 is only slightly smaller than the diameter 130 and is suitable for large extensions of the tie 100.

Figure 1:
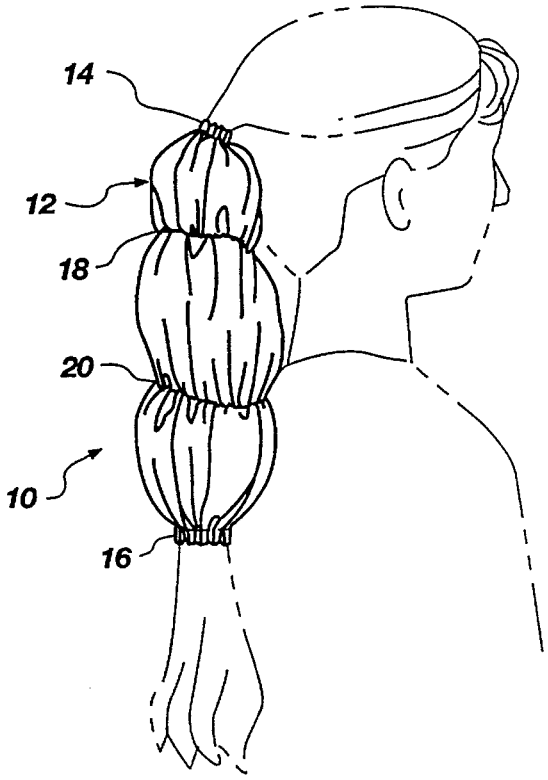
FIG. 1 is an isometric view of an accessory of the invention, having elasticized top and bottom loops, as worn by a user.
Figure 2:
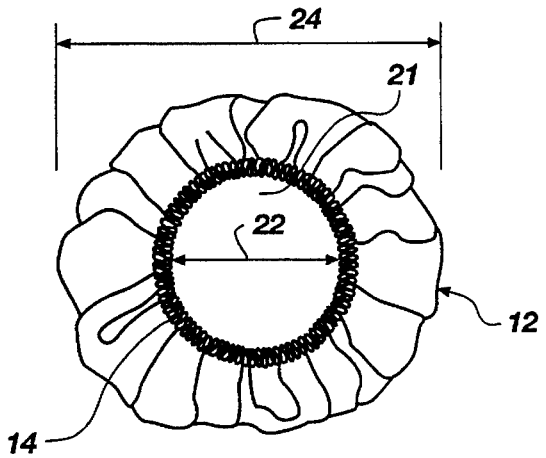
FIG. 2 is a top plan view of the accessory of FIG. 1.

In the embodiment of the invention illustrated in FIGS. 21–24, the sleeve 12 is smaller than that of FIG. 1. The cord 36, tied in a bow 38, secures the top loop 14 of the hair of a user in a ponytail. The top loop 14 may be gathered or expanded as needed to permit the hair to be received therethrough and to tighten the top loop 14 about the hair for retention.

Figure 21:
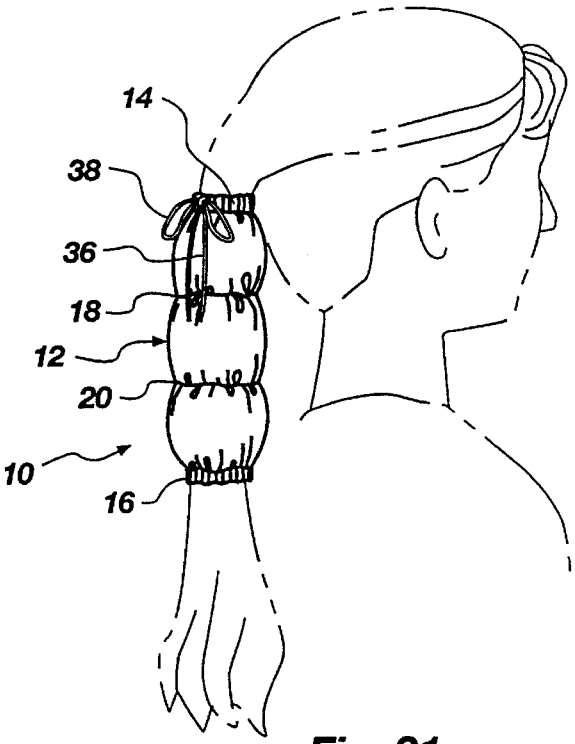
FIG. 21 is an isometric view of one embodiment of the invention using a cord threaded through the top loop of the accessory of the invention for tightening, securing, and tying the top loop of the accessory.
Figure 22:
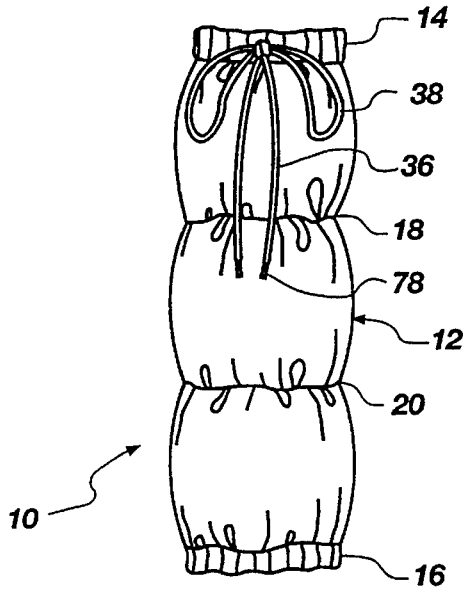
FIG. 22 is a rear elevation view of the accessory of FIG. 21.
Figure 23:
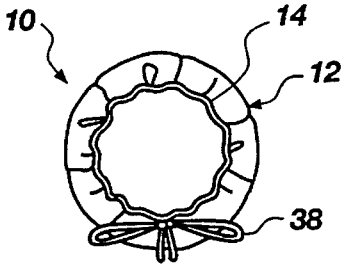
FIG. 23 is a top plan view of the accessory of FIG. 21.
Figure 24:
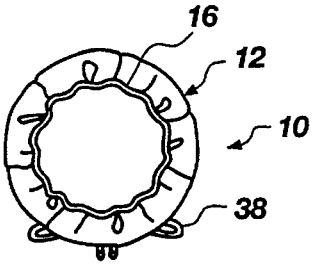
FIG. 24 is a bottom plan view of the accessory of FIG. 21.
Figure 25:
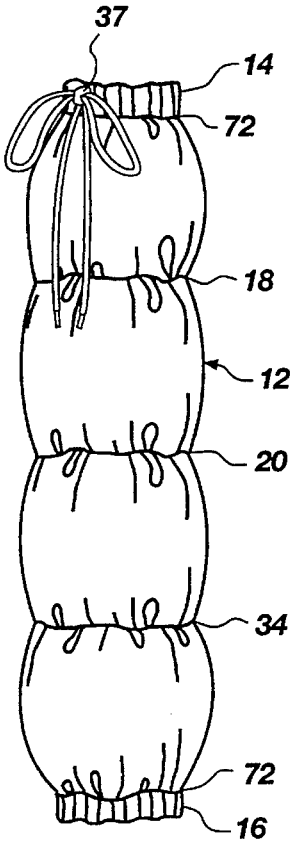
FIG. 25 is an alternate embodiment of the accessory of FIG. 21 having three gathers intermediate the top and bottom loops.

The embodiment of FIG. 25 is an alternative to the article of FIG. 21. The third gather 34 is included between the top loop 14 and bottom loop 16. The first gather 18, second gather 20, and third gather 34 may be spaced apart equidistantly as illustrated between the top loop 14 and bottom loop 16. However, since the function of the gathers 18, 20, 34 and the loops 14, 16 is to control the hair of a user, radial and axial spacing along the sleeve 12 can be altered for aesthetics while maintaining functionality.

Figure 26:
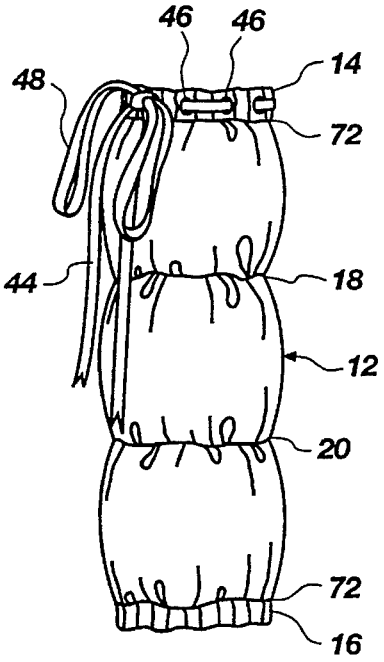
FIG. 26 is a rear quarter elevation view of the accessory of the invention in an embodiment employing ribbon laced through the top loop for tightening the top loop and securing the accessory to the hair of a user.

FIG. 26 illustrates the use of a ribbon 44 through threaded apertures 46 perforating the top loop 14. The ribbon 44 in this embodiment is laced in and out through the apertures 46 about the top loop 14. The top loop 14 and bottom loop 16 are created by hems 72 in this embodiment. The bottom loop 16 contains a band 50 (not shown) that elastically contracts the bottom loop 16 to maintain it in close proximity to the hair of a user. The ribbon 44 is tightened around the hair of a user after the hair has been gathered together in a ponytail. The ribbon 44 is tightened and tied in a bow 48 for securement. An alternative method for using the sleeve 12 is to first tie the hair of a user by a conventional means, and thereafter tighten the ribbon 44, necessarily tightening the loop 14 around the hair of a user above whatever means is used to secure the hair in a ponytail.

Figure 27:
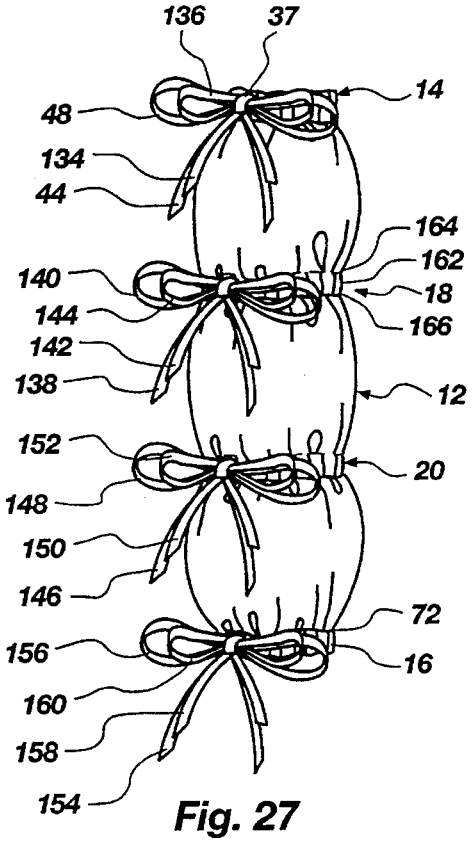
FIG. 27 is a rear quarter elevation view of an alternate embodiment of the accessory of the invention using multiple ribbons threaded through hemmed passages at the top loop, bottom loop and intermediate gathers for tightening or securing the top and bottom loops and the intermediate gathers.
Figure 28:
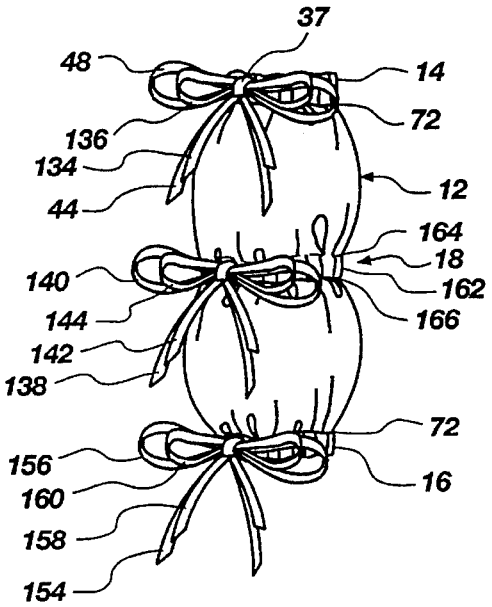
FIG. 28 is a rear quarter isometric view of an alternate embodiment of the accessory of FIG. 27 having a single intermediate gather between the top and bottom loops.

The embodiment of FIGS. 27–28 relies on the ribbons 134, 138, 142, 146, 150, 154, 148, 160 to contract the top loop 14, the first gather 18, the second gather 20, and the bottom loop 16 in pairs, respectively. The ribbons 44, 134 are threaded through the top loop 14 and tied in bows 48, 136, respectively, after being inserted in and drawn out through the aperture 37 into top loop 14. Similarly, the ribbons 138, 142 are inserted into the first gather 18, exiting after traversing the first gather 18 to be formed into the bows 140, 144, respectively. Likewise, the ribbons 146, 150 form the bows 148, 152, respectively, securing the second gather 20. Also, the ribbons 154, 158 are formed into the bows 156, 160, securing the bottom loop 16. The hem 164 and hem 166 form a channel 73 (not shown) at the first gather 18. The second gather 20 is constructed similarly. This construction contrasts to the embodiments of FIGS. 21–26, wherein the first and second gathers 18, 20 are formed simply by sewing an elasticized material (not shown) to the sleeve 12, relying upon the elastic to contract after sewing to form the gathers 18, 20.

Figure 29:
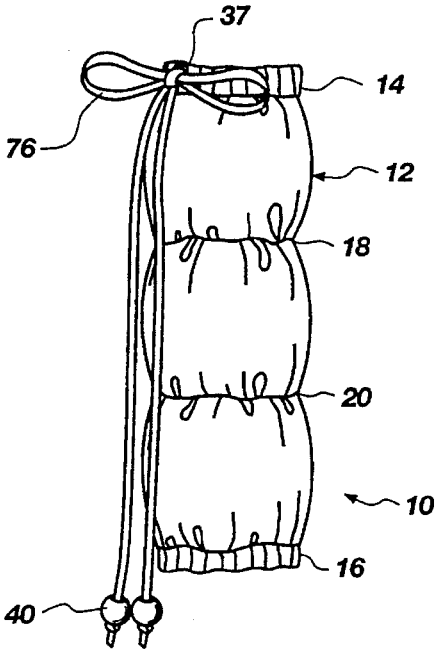
FIG. 29 is a rear quarter elevation view of the accessory of the invention using a cord having beaded ends for holding the ends of the cord down.

In the embodiment of FIG. 29, a lace 76, used in the same context as a shoelace to describe a cord-like material, is inserted through the aperture 37 to be passed through a channel 73 (not shown) inside the top loop 14 and is drawn back out through the aperture 37 to be tied, for securing the top loop 14. The beads 40 maintain the orientation of the lace 76. Therefore, the beads 40 must not be sufficiently heavy to untie the lace 76, nor should the lace 76 be made of a material that is too slippery or too stiff to be tied easily.

Figure 30:
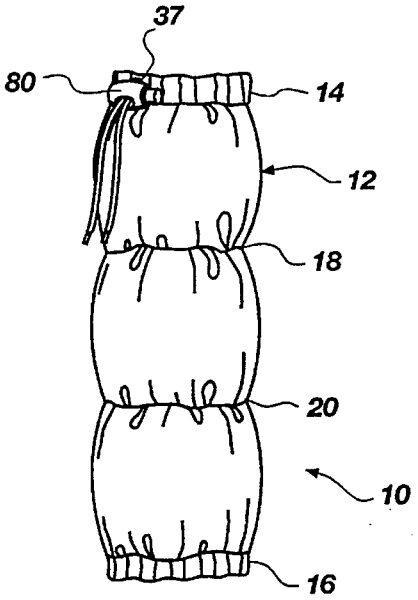
FIG. 30 is a rear quarter elevation view of the accessory of FIG. 14.

FIG. 30 illustrates the sleeve 12 configured to use a cord pull 80 in the manner illustrated in FIG. 14. The cord pull 80 is an alternative to tying and has the singular advantage of being easily releasable with a minimum of manipulation by the fingers.

Figure 31:
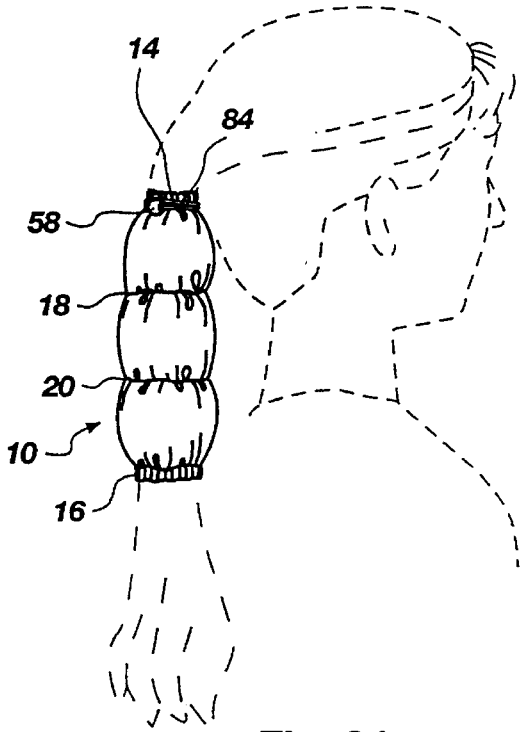
FIG. 31 is an isometric view of the accessory of the invention as worn by a user, the accessory having a bead-type pull for accessing the elastic to tighten the top loop.
Figure 32:
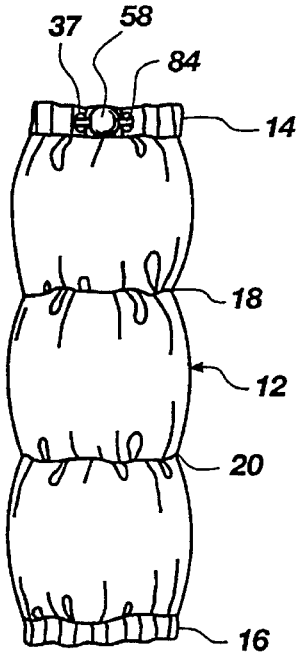
FIG. 32 is a rear elevation view of the accessory of FIG. 31.
Figure 33:
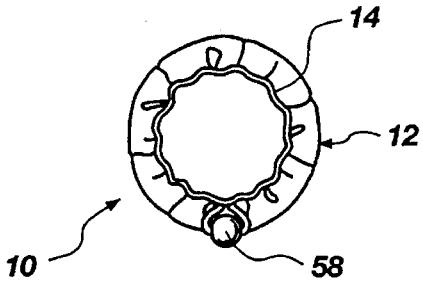
FIG. 33 is a top plan view of the accessory of FIG. 31.

The embodiment of FIGS. 31–33 illustrate the use of a bead 58 to operate as a pull 52 for tightening the top loop 14. The importance of the bead 58 captured by the shock cord 84 is to prevent the elasticized shock cord 84 from retreating back into the aperture 37 to become inaccessible to a user.

For convenience, a user may grasp the bead 58 and immediately draw the elasticized shock cord 84 from the aperture 37, tightening the top loop 14. The user then may wrap the shock cord 84 around the top loop 14 and back around the top loop 14 again. The result is to place the bead 58 in the same position it occupies in FIG. 32 with the shock cord 84 extended to wrap around the top loop 14 three times. That is, the shock cord 84 extends once around the top loop 14 on the inside channel 73 (not shown) and wraps twice around the outside of the top loop 14.

Figure 34:
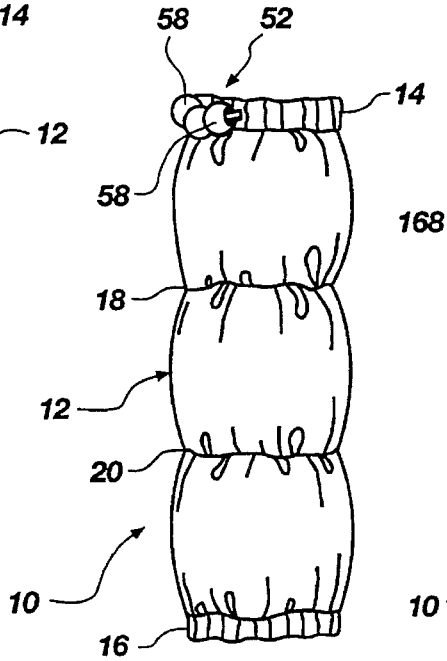
FIG. 34 is a rear quarter elevation view of an alternate embodiment of the accessory of the invention using multiple beads as a pull for the elastic through the top loop.
Figure 35:
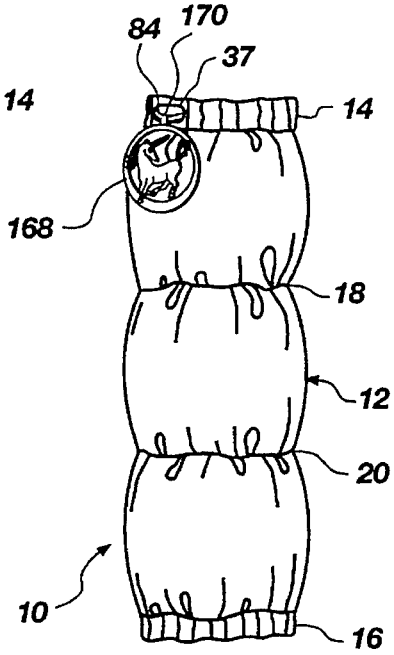
FIG. 35 is a rear quarter elevation view of an alternate embodiment of the invention using a fob attached to the elastic through the top loop as a pull to tighten the elastic.

In the embodiment of FIG. 34, the pull 52 is comprised of a plurality of beads 58. The pull 52 operates exactly the same as the individual bead 58 of FIGS. 31–33. Similarly, the fob 168 of FIG. 35 is attached by the extension 170, which is captured on the shock cord 84 passing into and out of the aperture 37. The fob 168 operates as the bead 58 of FIGS. 31–33 to draw the shock cord 84 through the aperture 37 to be wrapped around the top loop 14 twice. Thus, the fob 168 may have a decorative motif that would remain visible in the location shown in FIG. 35 after the shock cord 84 has been tightened appropriately around the hair of a user.

Figure 36:
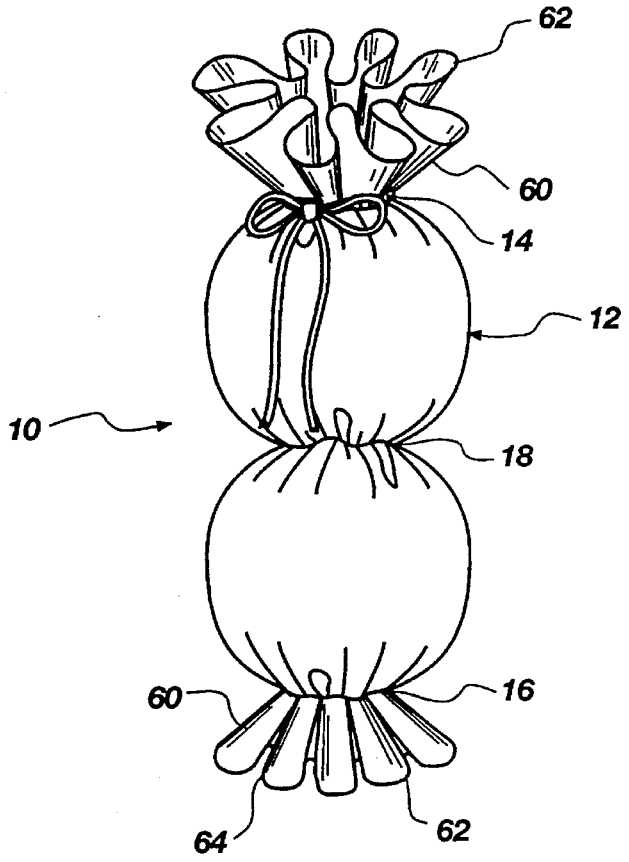
FIG. 36 is a rear elevation view of an alternate embodiment of the invention having flared fabric end which may be of French ribbon-type fabric extending above the top loop and below the bottom loop, with the accessory being extended longitudinally.
Figure 37:
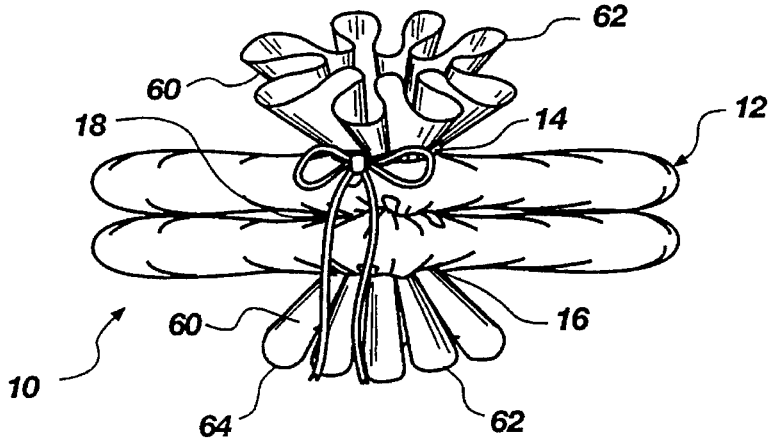
FIG. 37 is a rear elevation view of an alternate embodiment of the invention having flared fabric end which may be of French ribbon-type fabric extending above the top loop and below the bottom loop, with the accessory being compressed longitudinally.

FIGS. 36–37 illustrate a more dramatic flare 60 extending above the top loop 14 and a flare 60 extending below the bottom loop 16. The stiffener 62 is typically comprised of wire, but may be formed of a stiff polymeric material that forms scallops 64 for a ruffled appearance.

The sleeve 12 may be extended or compressed axially. If the top loop 14 is spaced away from the bottom loop 16 as far as possible, then the sleeve 12 retains the hair of a ponytail of a user along the majority of the ponytail. However, when the bottom loop 16 is placed in proximity to the top loop 14, then the hair is left free flowing, being secured only in one localized region. For aesthetic purposes, the bottom loop 16 may actually be placed above or encircling the top loop 14, convoluting the sleeve 12 to leave little more than the flares 60 visible.

The invention is used in different manners, depending on the configuration. The configuration of FIGS. 1–7 is used by axially compressing the sleeve 12 to place the top loop 14 and bottom loop 16 in close proximity. The user then places a finger or fingers from each hand through the aperture 21 to stretch the inside diameter 22. The user then drops or draws the hair through the aperture 21.

In the alternative, a user may insert a finger or fingers and a thumb of one hand through the aperture 21 first passing the fingers and thumb through the bottom loop 16 and then through the top loop 14. Then, the user grasps the bundled hair, drawing the hair down through the aperture 21 and through the length 26 of the sleeve 12. Since the length 26 is relatively short, this is easily accomplished.

Once the hair of a user is enclosed within the sleeve 12, the hair extending out through the top loop 14 and the bottom loop 16, the relative spacing between the top loop 14 and bottom loop 16 can be adjusted. The first and second gathers 18, 20 and the bottom loop 16 can be adjusted tightly after being positioned at their desired positions, if means to tie or tighten are provided. If only the band 50 is provided therein, then the user simply slides the gathers 18, 20 and the bottom loop 16 to the desired relative positions.

In the embodiments of FIGS. 8, 9, 21–26, and 29, the user must release the top loop 14 and the bottom loop 16 from the restraint of whatever means are used to secure them. That is, any cords 36 of FIG. 8 or ribbons 44 of FIG. 9, or the like, must be released so that the top loop 14 and bottom loop 16 as well as the gathers 18, 20, 34 can be expanded to enlarge the aperture 21 through the sleeve 12. Thereafter, the hair is drawn through the sleeve 12, as explained above, and the cord 36 or ribbon 44 or other tie 100 is drawn tight to capture the hair snugly within the sleeve 12.

The other embodiments having elasticized ties 100, such as the band 50, are treated similarly except that the band 50 is drawn out of the aperture 37 in the top loop 14 to secure the hair therein. The band 50 is then drawn tight, wrapped twice around the top loop 14 and released, leaving the pull 52 visible in its original orientation and location.

Several other variations are obtainable by combining the illustrated features of the several embodiments. Alternative functional and decorative embodiments can result. For example, any tie 100, the band 50 or cord 36 for example, in the top loop 14 may be combined with any tie 100, ribbons 44, 66, 138, 142 for example, at the first and second gathers 18, 20 or at the bottom loop 16. Ribbons 44, 66, 138, 142 (for example) may be aesthetically pleasing, but also have the functional advantage of allowing various degrees of gathering of the sleeve 12, whereas any elastomeric member such as the shock cord 84 or the band 50 will tend to constrict to a minimum size when released.

It is understood that the embodiments herein are by way of example and not limitation. Numerous alternative embodiments will be obvious to those skilled in the art without departing from the invention, which is limited only by the claims.

What is chimed is:

1. A retainer for hair in a ponytail, said retainer comprising:

a sleeve for surrounding a user's hair formed in a ponytail;

a first loop associated with the sleeve proximate a first end thereof for securing the sleeve around a user's hair in a ponytail;

a second loop associated with the sleeve proximate a second end thereof for positioning the second end along the length of the user's hair;

means for gathering the sleeve intermediate the first loop and the second loop;

a first bloused portion positioned between the first loop and the gathering means to extend radially beyond the first loop and the gathering means; and a second bloused portion positioned between the second loop and the gathering means to extend radially beyond the first loop and the gathering means.

2. The retainer of claim 1, wherein the first loop further comprises a tie formed to be tied in a bow.

3. The retainer of claim 1, wherein the first loop further comprises an elastic material stretchable by a user between a first circumference and a second circumference.

4. The retainer of claim 3, wherein the first circumference is greater than 4 inches and the second circumference is less than 4 inches.

5. The retainer of claim 1, wherein the gathering means comprises a third loop positioned intermediate the first and second loops.

6. The retainer of claim 5, further comprising a plurality of loops, and wherein each loop of the plurality of loops is positionable by a user with respect to the first loop.

7. The retainer of claim 1, wherein the second loop is configured to selectively close the sleeve for completely containing a user's hair therein.

8. The retainer of claim 1, wherein the sleeve is comprised of a synthetic polymer.

9. The retainer of claim 1, wherein the sleeve is comprised of a non-woven paper fabric.

10. The retainer of claim 1, wherein the sleeve is comprised of a chemical-resistant material.

11. The retainer of claim 1, wherein the sleeve is comprised of a heat-resistant material.

12. The retainer of claim 1, wherein the sleeve is comprised of an electrically conductive material.

13. The retainer of claim 1, wherein the sleeve is comprised of a textile fabric.

14. The retainer of claim 1, wherein the sleeve is comprised of a moisture absorbent material.

15. The retainer of claim 1, wherein the sleeve is comprised of a moisture resistant material.

16. The retainer of claim 1, wherein the sleeve is comprised of a dielectric material.

17. A method of making a hair accessory comprising the steps of:

forming a sheet of fabric having a first surface, second surface, first end, second end, first edge, and second edge;

forming a first way along a width of the sheet proximate one end of the sheet;

forming a second way along the width of the sheet proximate a second end of the sheet;

securing intermediate the first end and the second end, means for gathering, the gathering means being oriented similarly to the first and second ways; and securing the first edge to the second edge to form a circumference associated with the gathering means, thereby forming a first bloused portion positioned between the gathering means and a first loop formed by the first way, and forming a second bloused portion positioned between the gathering means and a second loop formed by the second way, the first and second bloused portions extending radially beyond the circumference.

18. The method of claim 17 further comprising the step of threading an elongated member through the first way.

19. The method of claim 18 further comprising the step of threading the elongated member through a pull positioned to be accessible to a user.

20. A method of retaining a user's hair, said method comprising the steps of:

opening an internal circumference of an elongate sleeve, the sleeve having a top end, a bottom end, and an intermediate gather extending around a gathered circumference thereof, the sleeve thereby having a first bloused portion positioned between the top loop and the intermediate gather and a second bloused portion positioned between the bottom loop and the intermediate gather, the first and second bloused portions extending radially beyond the circumference;

placing a user's hair through an interior of the sleeve to extend into the top end and out of the bottom end;

constricting the internal circumference by the tightening of a top loop secured proximate the top end and a bottom loop proximate the bottom end; and adjusting the elongation of the sleeve by positioning with respect to the top loop the bottom loop.

21. The method of claim 20 further comprising the step of adjusting the gathered circumference of the sleeve.

22. The method of claim 21 further comprising the step of adjusting a second gather circumference of a second intermediate gather.

23. The method of claim 20 wherein the step of constricting the internal circumference further includes the steps of drawing tight a tie secured to the sleeve proximate the intermediate gather and tying one part of the tie to another part of the tie.

24. The method of claim 23 wherein the step of tying the tie further includes the step of forming a bow in the tie.

25. The method of claim 20 wherein the step of constricting the internal circumference includes the steps of drawing tight an elasticized band secured proximate the top end and wrapping the elasticized band around the sleeve proximate the top end.

26. The method of claim 25 wherein the step of drawing tight an elasticized band is preceded by the step of grasping a pull secured to the elasticized band.

* * * * *